US006145799A

United States Patent [19]

Khon

[11] Patent Number: 6,145,799

[45] Date of Patent: Nov. 14, 2000

[54] MAGNETIC COPY HOLDER FOR ONE-HANDED OPERATION

[76] Inventor: Trinh Cam Khon, 1739 Aprilsong Ct., San Jose, Calif. 95131

[21] Appl. No.: 09/187,681

[22] Filed: Nov. 5, 1998

[51] Int. Cl.[7] ..... B41J 11/02; A47G 1/17

[52] U.S. Cl. ..... 248/442.2; 248/206.5; 248/309.4

[58] Field of Search ..... 248/442.2, 309.4, 248/441.1, 451, 452, 467, 206.5, 316.5

[56] References Cited

U.S. PATENT DOCUMENTS

| | | | |
|---|---|---|---|
| 4,243,335 | 1/1981 | Singley | 248/442.2 |
| 4,287,676 | 9/1981 | Weinhaus | 248/206.5 |
| 4,475,705 | 10/1984 | Henneberg et al. | 248/451 |
| 4,892,334 | 1/1990 | Sinclair | 248/441.1 |
| 5,083,733 | 1/1992 | Marino et al. | 248/309.4 |
| 5,145,141 | 9/1992 | Hunter | 248/452 |

FOREIGN PATENT DOCUMENTS

| | | | |
|---|---|---|---|
| 1580920 | 9/1969 | France | 248/309.4 |

*Primary Examiner*—Ramon O Ramirez
*Assistant Examiner*—Jerome Deluca
*Attorney, Agent, or Firm*—Jeffrey P. Aiello; Carol D. Titus; James J. Leary

[57] ABSTRACT

A device that incorporates magnetic componentry frictionally engage one or more sheets of paper therebetween is provided. The magnetic componentry of the invention is selected to exert sufficient magnetic force therebetween to retain the paper. The invention includes a magnetic backing member and a ferromagnetic retaining clip rotatably coupled thereto for frictionally engaging paper therebetween. The retaining clip may have an upturned end to facilitate disposing paper between the clip and backing member. The backing member and retaining clip are selected so that the backing member exerts just enough magnet force on the retaining clip to draw the clip against the backing member with enough pressure to retain up to several thin sheets of paper therebetween. The present invention is well suited for one-handed operation thereof.

20 Claims, 7 Drawing Sheets

MAGNETIC COPY HOLDER FOR ONE-HANDED OPERATION

BACKGROUND OF THE INVENTION

1. Field of the Invention

The present invention relates generally to devices used to retain documents, and more particularly, to a magnetic copy holder.

2. Description of Related Art

A number of different devices in the prior art have been provided for holding paper for viewing. Most notably, there are several known reading stands and copy holders which are useful in applications such as typing and lectures. Copy holders typically comprise a planar backboard for flatly retaining one or more sheets of paper thereon and a support for holding the backboard at a selected angle relative to the viewer.

A spring loaded clip, or other similar device, may be provided along a top edge of the backboard. The clip would be provided to tightly retain paper positioned on the backboard against the backboard, to prevent the paper from inadvertently moving about or from falling off the backboard. A disadvantage of the spring loaded clip, is that it presses the paper against the backboard with significant pressure. The pressure exerted by the clip, makes it virtually impossible to remove the paper from the backboard, without manually rotating the clip away from the backboard. Attempting to remove the paper held between the clip and backboard usually results in the paper tearing. Further, since the spring-loaded clip presses tightly against the backboard, it is virtually impossible to slide paper between the clip and backboard without manually rotating the clip away from the backboard, and holding the clip, as the paper is slid between the clip and backboard. Thus, this design not afford one-handed operation thereof.

Additionally a tray or shelf may be provided along a bottom edge of the backboard. The shelf may prevent paper retained on the backboard from sliding off the copy holder or may retain articles, such as pens and pencils, on the copy holder.

Another well known embodiment of a copy holder is configured to be coupled to a data display device, such as a computer monitor. In this embodiment, the copy holder includes a somewhat "L" shaped mounting bracket. The bracket is typically secured to the top surface and an adjacent side surface with a strip of adhesive tape.

A support arm is rotatably coupled to the mounting bracket for supporting one or more sheets of paper adjacent to a viewing screen of the monitor. A number of different methods are provided for coupling the sheets of paper to the support arm. Once such method includes providing a channel in the support arm that is configured to receive the edge of a sheet of paper therein. An aperture is formed in the support arm for receiving a paper retaining mechanism therein.

The paper retaining mechanism may comprise any suitable bracket adapted to be retained in the aperture and couple one or more sheets of paper therein. One example of a paper retaining bracket comprises a bracket that is configured to be snap-fit into the support arm aperture. The bracket has a tapered paper receiving end that narrows towards a bottom edge of the support arm. A roller is slidably retained in the receiving end of the bracket for frictionally engaging paper when it is disposed in the bracket In use, an edge of one or more sheets of paper is positioned beneath the channel of the support arm. As the edge of the paper is disposed into the channel, the paper contact the roller, causing the roller to slide upwardly or rotate, or potentially both, in the paper receiving portion of the bracket. Once the paper is suitably positioned in the channel, the tapered receiving end of the bracket biases the roller against a surface of the bracket, with the paper interposed therebetween, to frictionally engage the paper. The paper is removed from the channel and bracket, by sliding the paper longitudinally along the channel.

However, a disadvantage of the described paper retaining bracket is that it is not well suited for use with substantially thin sheets of paper, since the paper must be of sufficient thickness to induce a rotation or displacement of the roller to frictionally engage the paper.

SUMMARY OF THE INVENTION

The present invention comprises a device that incorporates magnetic componentry. The magnetic components of the present invention coact to frictionally engage one or more sheets of paper therebetween. The magnetic componentry of the invention is selected to exert sufficient magnetic force therebetween to retain the paper.

In an exemplary embodiment, the present invention includes a backing member that comprises a magnetic material. The backing member may comprise either a known ferromagnetic or ceramic magnetic material. A ferromagnetic retaining clip is rotatably coupled to the backing member for frictionally engaging paper therebetween, to hold the paper against the backing member. The retaining clip may have an upturned end to facilitate disposing paper between the clip and backing member. The backing member and retaining clip are selected so that the backing member exerts just enough magnet force on the retaining clip to draw the clip against the backing member with enough pressure to retain up to several thin sheets of paper therebetween.

The paper is coupled to the invented copy holder, by a user first grasping the paper, preferably between their thumb and forefinger. The paper is then positioned between the clip and backing member, with the user's thumb located adjacent to the clip. The clip is then rotated away from the backing member, while the paper is simultaneously slid upward along the member. Once the paper is suitably positioned between the backing member and clip, the clip is released. The magnetic force that the backing member exerts on the clip draws the clip against the backing member with sufficient force to hold the paper between the clip and backing member. The user then releases the paper to retain the paper in the invented copy holder.

The paper is easily released from the invented copy holder, by simply grasping the paper and pulling the paper away from the backing member. Thus, the present invention is well suited for one-handed operation thereof.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
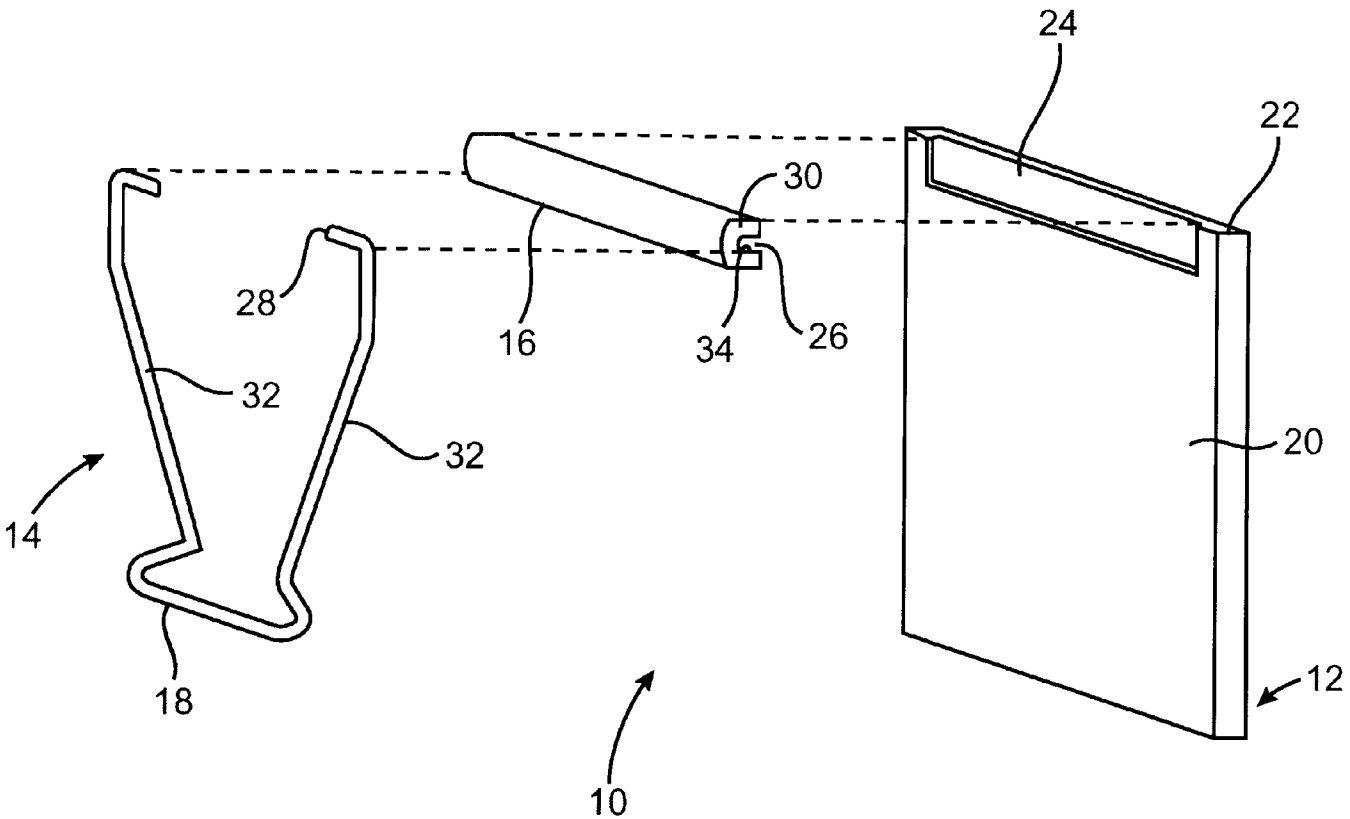
FIG. 1 is an exploded, perspective view showing a first preferred embodiment of a magnetic paper retaining device of the present invention.

The following description is provided to enable any person skilled in the art to make and use the invention and sets forth the best modes presently contemplated by the inventor of carrying out his invention. Various modifications, however, will remain readily apparent to those skilled in the art, since the generic principles of the present invention have been defined herein.

Referring now to FIGS. 1–3B of the drawings, there is shown, generally at 10, a first preferred embodiment of a magnetic paper retaining device constructed according to the principles of the present invention. The present invention comprises a magnetic backing member 12, a retaining clip 14, and a housing 16 for coupling the clip 14 to the backing member 12.

In the preferred embodiment, the backing member 12 comprises a known ceramic magnet, but alternatively may comprise other known ferromagnetic materials. The backing member 12 may be approximately 5 centimeters (cm) long, 3 cm wide, and 0.6 cm thick. The backing member 12 is fabricated using known methods. The backing member 12 exerts a magnetic field of sufficient strength to enable the device 10 to be magnetically coupled to a selected magnetic surface for retaining paper from the magnetic surface. Such a magnetic surface may be the metal sides of a refrigerator or other household appliance, for example.

The retaining clip 14 comprises a magnetic material for attraction to the backing member 12. Preferably, the clip 14 comprises a ferromagnetic material, such as a steel or stainless steel alloy, that is somewhat light and rigid. A known steel wire having a diameter of about 2.5 millimeters (mm) may be used to fabricate the clip 14. Additionally, the retaining clip 14 may be provided with an upturned receiving end portion 18. The receiving end 18 may also be substantially ovular in cross-sectional configured to facilitate disposing sheets of paper between the clip 14 and a retaining surface 20 of the backing member 12.

The housing 16 is provided to rotatably couple the retaining clip 14 to the backing member 12. The housing 16 may comprise any suitable light and rigid material. In the preferred embodiment, the housing 16 may comprise a known ceramic or plastic material. The housing 16 is affixed to the retaining surface 20 of the backing member 12 along a top edge 22 thereof. The housing 16 is affixed to the member 12 using known means, such as a commercially available adhesive. A groove 24 may be formed in the retaining surface 20 for receiving the housing 16.

Figure 2A:
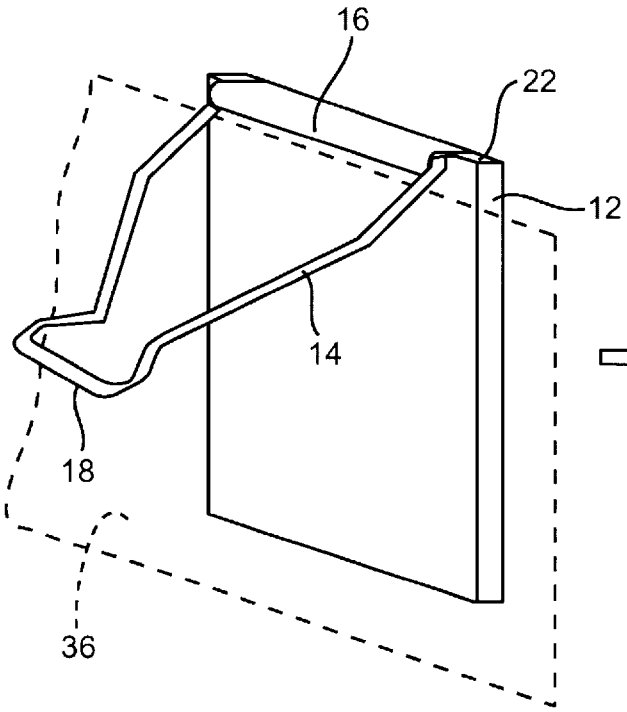
FIGS. 2A and 2B show a block diagram showing the preferred embodiment in an open position.
Figure 2B:
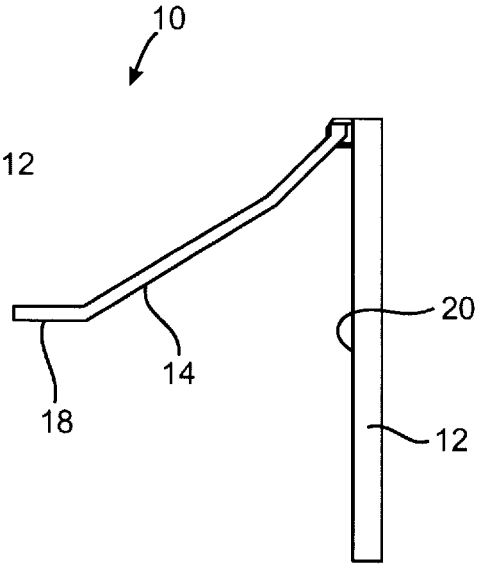
Figure 3A:
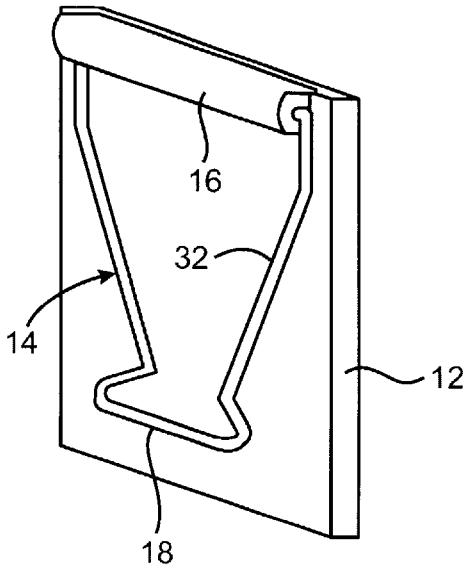
FIGS. 3A and 3B showing the preferred embodiment in a closed position.
Figure 3B:
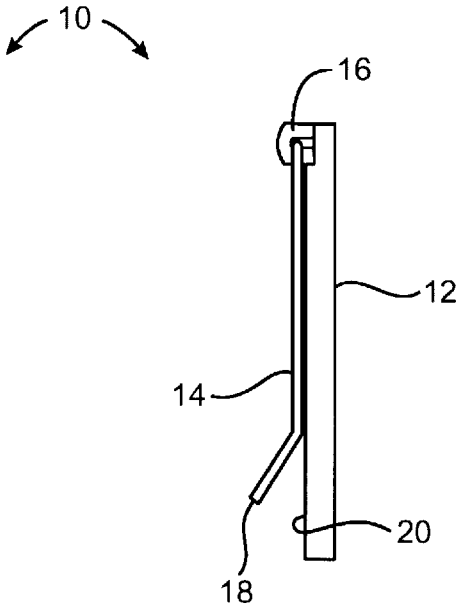

The housing 16 may be configured with receiving means for receiving inwardly projecting tangs 28 of the clip 14 for detachably coupling the clip 14 does to the housing 16. The receiving means may comprise a cavity 26 formed in each end 30 of the housing 16 or a channel that extends the length of housing 16. Sides 32 of the clip 16 may be slightly deflectable so that the tangs 28 may be snap-fit into the cavities 26, thus rotatably coupling the clip 14 to the backing member 12. The cavities 26 may be formed with chordal sides 34 that may facilitate retaining the clip in the open position, as shown in FIGS. 2A and 2B. Means may also be provided for permanently securing the clip 14 to the housing 16.

Figure 7:
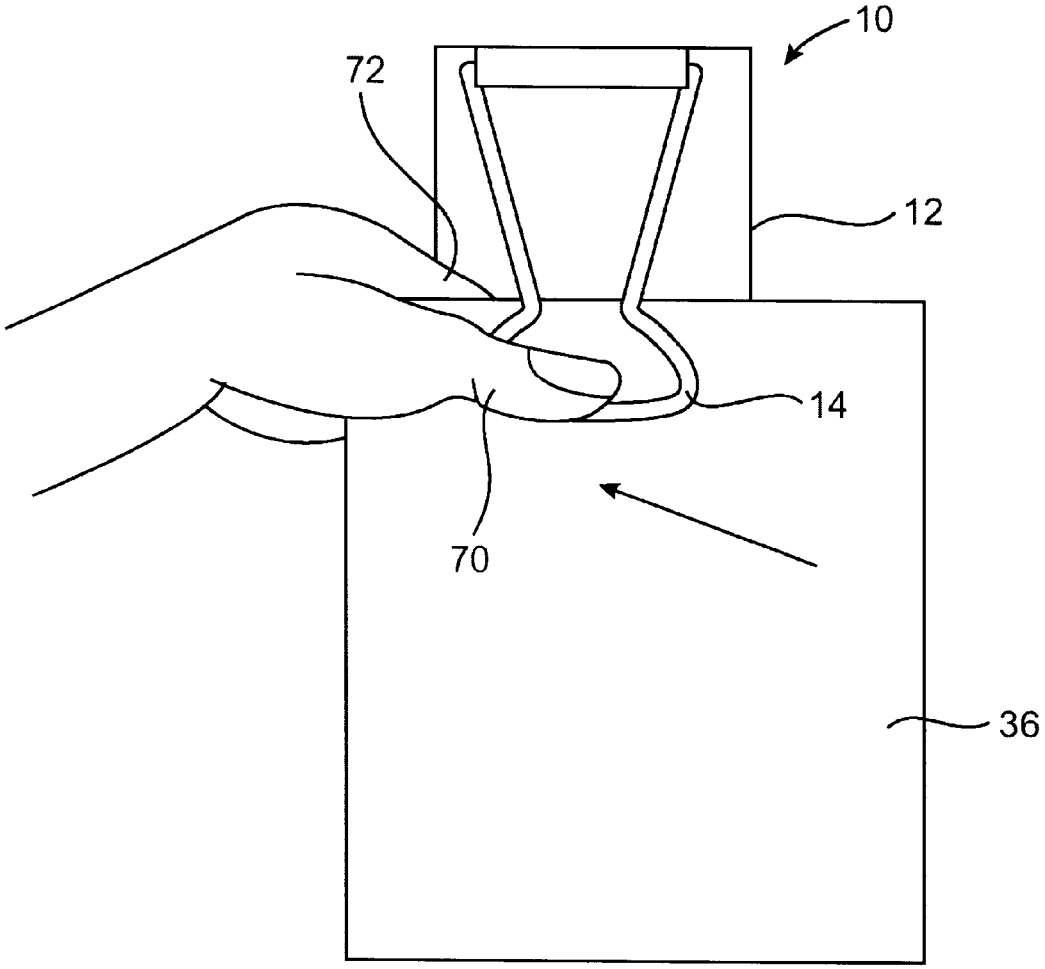
FIGS. 7–9 show a series of steps for coupling paper to the magnetic paper retaining device of the present invention.
Figure 8:
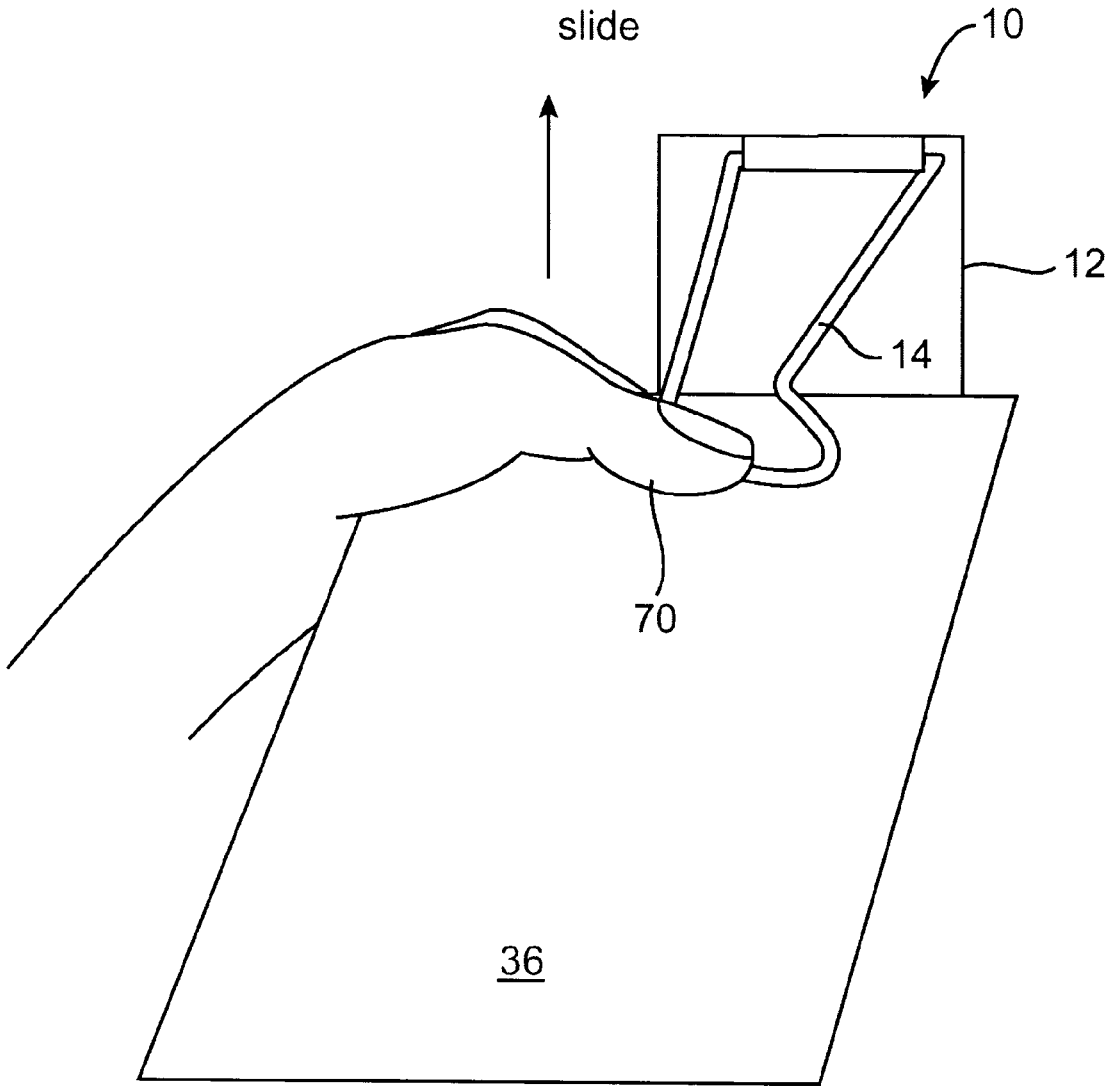
Figure 9:
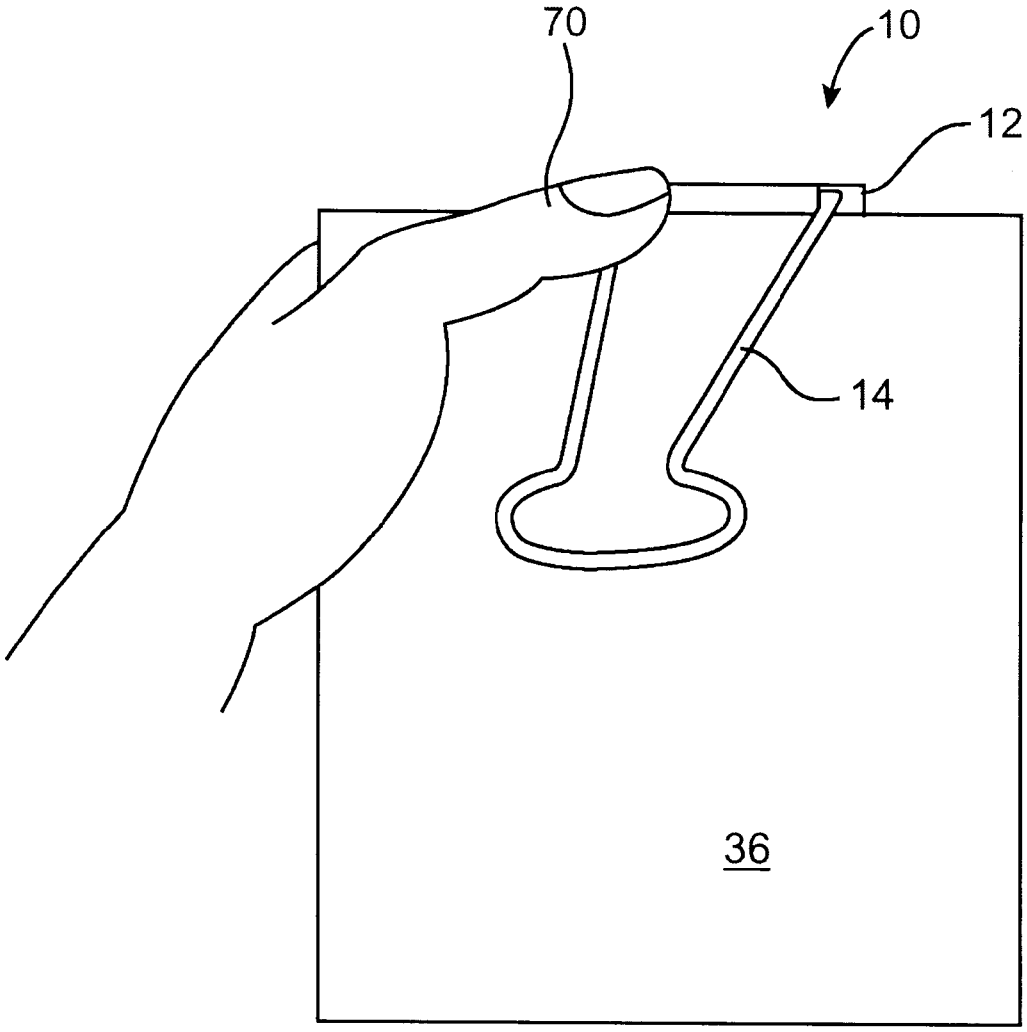

Referring now to FIGS. 7–9 of the drawings, a sheet of paper 36 is retained by the device 10 of the present invention, by a user first grasping the paper, preferably between their thumb 70 and forefinger 72. The paper 36 is then positioned between the clip 14 and backing member 12, with the user's thumb 70 located adjacent to the clip. The clip is then rotated away from the backing member, while the paper 36 is simultaneously slid upward along the member 12. Once the paper is suitably positioned between the backing member and clip, the clip 14 is released. The magnetic force that the backing member 12 exerts on the clip 14 draws the clip against the backing member with sufficient force to hold the paper 36 therebetween. The user then releases the paper 36, to retain the paper in the invented copy holder 10.

The paper 36 is easily released from the copy holder 10, by simply grasping the paper 36 and pulling the paper away from the backing member 12. Thus, the present invention 10 is well suited for one-handed operation thereof.

Figure 4:
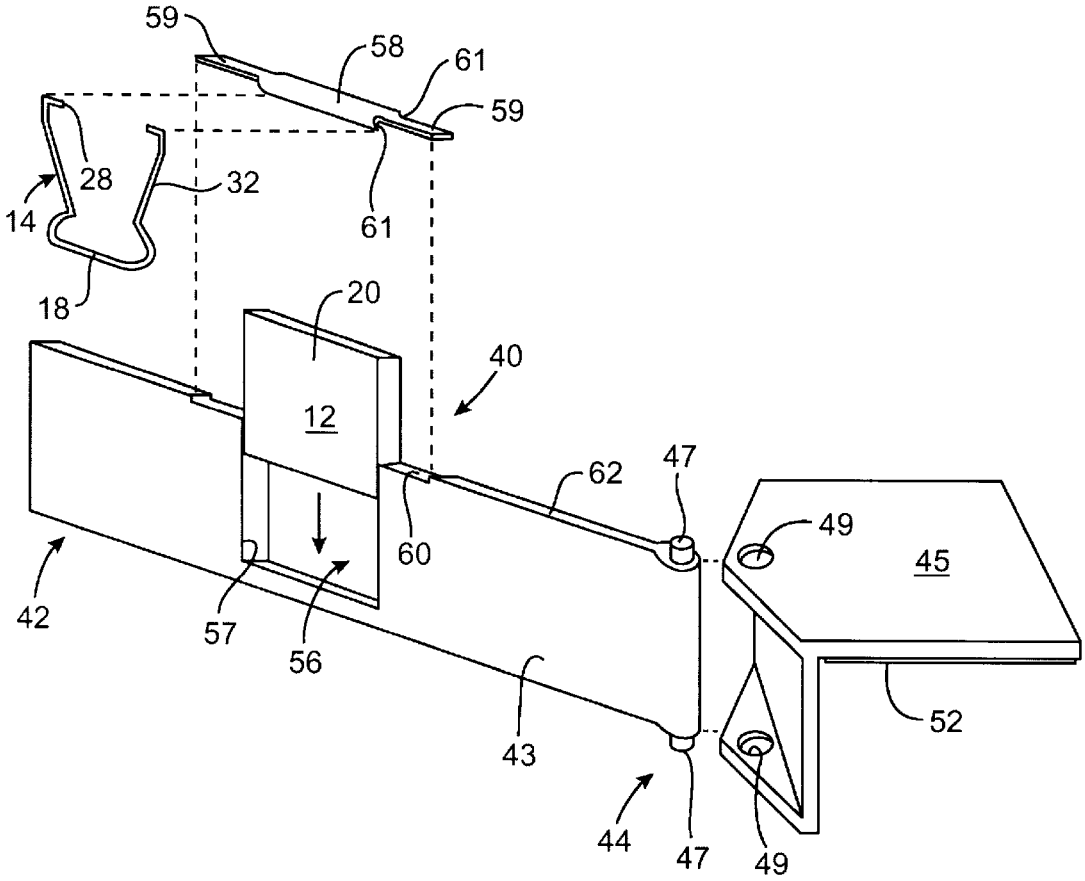
FIG. 4 is an exploded, perspective view showing a second preferred embodiment of the magnetic paper retaining device of the present invention.
Figure 5:
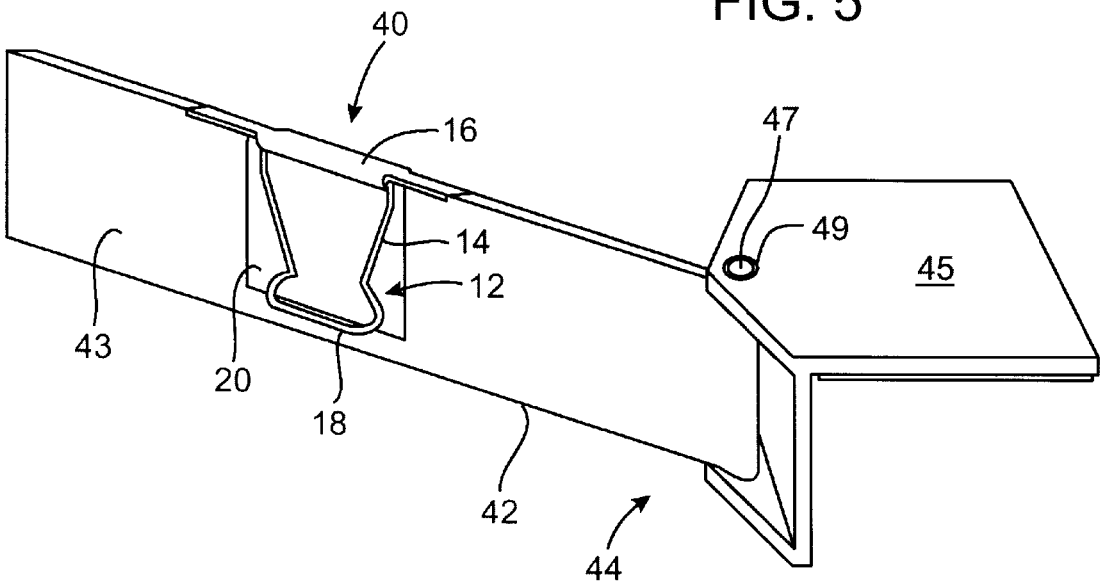
FIG. 5 is a perspective view showing the second preferred embodiment.
Figure 6:
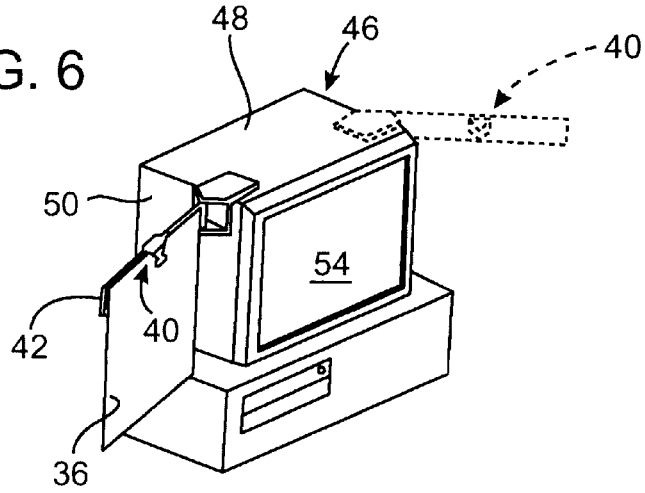
FIG. 6 is a perspective view showing the second preferred embodiment coupled to a computer monitor.

Referring to FIGS. 4–6, there is shown a second preferred embodiment the 40 of the present invention. In the second embodiment 40, the magnetic paper retaining device is retained in a support arm 42 of a copy holder 44 configured for use with a computer monitor 46 or other similar data display device. In this embodiment, the copy holder 44 includes a somewhat "L" shaped mounting bracket 45 that typically is secured to a top surface 48 and an adjacent side surface 50 of the monitor 46 with a strip of adhesive tape 52 or other known means. The support arm 42 is rotatably coupled to the mounting bracket 45 for supporting one or more sheets of paper 36 adjacent to a screen 54 of the monitor 46. A pair of projections 47 may be provided to mate with holes 49 formed in the bracket 45 to snap-fit the support arm 42 to the bracket 45.

An aperture 56 is formed in the support arm for receiving the backing member 12 of the present invention. The backing member 12 may be secured to the support arm 42 using known means. For example the backing member 12 may be snap-fit into the aperture 56 or may be affixed to sides 57 the aperture 56 using an appropriate adhesive. The retaining surface 20 of the backing member 12 extends flush with a front surface 43 of the arm 42 to flatly retain paper.

In the second embodiment 40, the housing 58 includes elongated sides 59 that are configured to be retained in a groove 60 formed in a top edge 62 of the arm 42. The housing is configured for use from either side of the screen 54. Somewhat cylindrical retaining means 61 extend between the elongated sides 59 thereof for receiving the inwardly projecting tangs 28 of the clip 14. Therefore, the clip 14 can be easily removed from one of the retaining means 61 and coupled to the remaining retaining means for either right-handed or left-handed use. The housing 58 is affixed to the arm 42 in the groove 60 using appropriate means. The clip 14 is then coupled to the housing 58 as previously discussed. The support arm 42 may be rotated relative to the monitor 46 for ease of viewing paper 36 retained by the present invention 10 adjacent to the screen 54.

Thus, there has been described a device that incorporates magnetic componentry frictionally engage one or more sheets of paper therebetween. The magnetic componentry of the invention is selected to exert sufficient magnetic force therebetween to retain the paper. The invention includes a magnetic backing member and a ferromagnetic retaining clip rotatably coupled thereto for frictionally engaging paper therebetween. The retaining clip may have an upturned end to facilitate disposing paper between the clip and backing member. The backing member and retaining clip are selected so that the backing member exerts just enough magnet force on the retaining clip to draw the clip against the backing member with enough pressure to retain up to several thin sheets of paper therebetween.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A device for retaining paper comprising:

a magnetic backing member; and a magnetic clip rotatably coupled to a front surface the backing member, the backing member exerting sufficient magnetic force on the clip to draw the clip against a front surface of the backing member with enough pressure to retain at least one sheet of paper therebetween.

2. The device of claim 1 wherein the clip has a bend creating an upturned end.

3. The device of claim 1 wherein the magnetic force on the retaining clip is sufficiently low to enable at least one sheet of paper to be slid between the backing member and retaining clip while the clip is in a closed position.

4. The device of claim 1 wherein at least a portion of the clip extends below a bottom edge of said backing member.

5. The device of claim 1 wherein the backing member has a generally planar front surface and a back surface of the clip lies generally in a plane such that when in a closed position the back surface of said clip lies generally parallel to the front surface of the backing member.

6. The device of claim 1 wherein the clip is coupled to the backing member with a housing, the housing being configured to retain the clip in an open position.

7. The device of claim 1 further comprising a housing for detachably coupling the clip to the backing member, the housing including two openings extending inward on each side of thereof, the openings being configured to receive a pair of inwardly projecting tangs of the clip for rotatably coupling the clip to the housing.

8. The device of claim 7 wherein the two openings have chordal sides.

9. The device of claim 1 wherein said clip is rotatably coupled to a front surface of said backing member.

10. A device for retaining paper comprising:

a magnetic backing member;

a magnetic retaining clip rotatably coupled to the backing member, the retaining clip having a wide, upturned receiving end to facilitate the rotation of the clip and insertion of paper between the clip and backing member; and a housing for rotatably coupling the clip to the backing member, the housing being configured to retain the clip in an open position, and wherein the backing member exerts sufficient magnetic force on the clip to draw the clip against the backing member with enough pressure to retain more than one sheet of paper between the backing member and the clip.

11. The device of claim 10 wherein the backing member has a back surface configured to attach to a selected generally flat surface formed of a magnetically attracted material.

12. The device of claim 10 wherein the housing, retaining clip and backing member coact to facilitate one-handed operation of the device.

13. The device of claim 10 further comprising a housing for detachably coupling the clip to the backing member, the housing including two openings extending inward on each side of thereof, the openings being configured to receive a pair of inwardly projecting tangs of the clip for rotatably coupling the clip to the housing.

14. The device of claim 13 wherein the two openings have chordal sides.

15. In a copy holder for a data display device, the copy holder including a mounting bracket configured to be secured to a top surface and an adjacent side surface of the display device, a support arm rotatably coupled to the mounting bracket, and an aperture formed in the support arm, an improved device for retaining paper, the improved paper retaining device comprising:

a magnetic backing member being retained in the aperture; and a magnetic retaining clip rotatably coupled to the backing member, the retaining clip having a wide, upturned receiving end to facilitate the insertion of paper between the clip and backing member, and wherein the backing member exerts sufficient magnetic force on the clip to draw the clip against the backing member with enough pressure to retain more than one sheet of paper between the backing member and the clip, wherein the clip may be removed from one retaining means and coupled to a remaining retaining means for one of right-handed and left-handed use of the device.

16. The device of claim 15 wherein the support arm, retaining clip and backing member coact to facilitate one-handed operation of the device.

17. The device of claim 15 further comprising a housing for detachably coupling the clip to the backing member, the housing including two pairs of cylindrical retaining means positioned on each side of thereof, the retaining means for receiving a pair of inwardly projecting tangs of the clip for rotatably and detachably coupling the clip to the housing.

18. The device of claim 15 wherein the magnetic force that the backing member exerts on the retaining clip is sufficiently minimal to enable more than one thin sheet of paper to be slid between the backing member and retaining clip for frictionally engaging sheets paper interposed therebetween to retain the paper and for enabling removal of paper retained between the backing member and clip without damaging the paper.

19. In a copy holder for a data display device, the copy holder including a mounting bracket configured to be secured to a top surface and an adjacent side surface of the display device, a support arm rotatable coupled to the mounting bracket, and an aperture formed in the support arm, an improved device for retaining paper, the improved paper retaining device comprising:

a magnetic backing member being retained in the aperture; and a magnetic retaining clip rotatably coupled to the backing member, the retaining clip having a wide, upturned receiving end to facilitate the insertion of paper between the clip and backing member, and wherein the backing member exerts sufficient magnetic force on the clip to draw the clip against the backing member with enough pressure to retain more than one sheet of paper between the backing member and the clip, wherein a retaining surface of the backing member extends substantially flush with a front surface of the support arm to facilitate retaining of the paper on the support arm.

20. A device for retaining paper comprising:

a magnetic backing member; and a magnetic clip rotatably coupled to the backing member, the backing member exerting sufficient magnetic force on the clip to draw the clip against a front surface of the backing member with enough pressure to retain at least one sheet of paper therebetween, wherein at least a portion of the clip extends below a bottom edge of said backing member.

* * * * *